United States Patent [19]

Richmond

[11] 4,159,599

[45] Jul. 3, 1979

[54] GATE-OPENING AND CLOSING ASSEMBLY

[76] Inventor: Moscow K. Richmond, 2819 Butler Ave., Los Angeles, Calif. 90066

[21] Appl. No.: 792,506

[22] Filed: May 2, 1977

[51] Int. Cl.[2] ..... E05F 11/12; E05F 15/00

[52] U.S. Cl. ..... 49/363; 49/140; 192/93 R; 74/36

[58] Field of Search ..... 49/363, 139, 140; 192/96, 89 A, 93 R, 14, 12 R; 74/36

[56] References Cited

U.S. PATENT DOCUMENTS

| | | | |
|---|---|---|---|
| 899,999 | 9/1908 | Osher | 49/363 X |
| 1,202,129 | 10/1916 | Varnum | 49/363 |
| 1,380,789 | 6/1921 | Floeter | 192/93 R |
| 1,583,835 | 5/1926 | Hynes | 49/363 |
| 1,959,042 | 5/1934 | Staley | 49/139 X |
| 3,086,766 | 4/1963 | Woodin et al. | 49/363 |
| 3,791,071 | 2/1974 | Niklaus | 49/140 |

*Primary Examiner*—Philip C. Kannan
*Attorney, Agent, or Firm*—Robert J. Schaap

[57] ABSTRACT

An improved gate-opening and closing assembly which is designed to shiftably move a gate from an opened position to a closed position, and from the closed position to the opened position in a relative planar path. This assembly comprises a lever arm connected to the gate and a drive arm pivotally connected at one end to the lever arm. At the other end, the lever arm is connected to a motor through a clutch mechanism for opening and closing the gate. The drive arm is operatively connected to the motor, such that it moves in a somewhat arcuate path and which causes the lever arm to move in an arcuate path. According to this construction, the assembly permits opening and closing of a relatively large gate with simple harmonic motion. The pair of relatively small arms and the entire assembly can be located within a relatively confined space in order to permit movement of a gate of substantial size. The present invention also provides a unique clutch mechanism which permits operation of the drive arm and lever arm in the arcuate paths.

43 Claims, 11 Drawing Figures

GATE-OPENING AND CLOSING ASSEMBLY

BACKGROUND OF THE INVENTION

This invention relates in general to certain new and useful improvements in improved gate-opening and closing assemblies, and, more particularly, to gate-opening and closing assemblies and the method of using the same which shift a gate between an open and a closed position by an actuating lever converting rotary motion into linear motion for movement of the gate.

In recent years, automatic gate and door openers have become popular and have received increased prominence in commercial application. Generally, these automatic gate and door openers operate on the basis of radio transmitter and receiver systems, such that a radio transmitter, when actuated, will generate a particular frequency signal which is sensed by the receiver to automatically operate the gate or door in order to open or close the same. The radio frequency receiver-transmitter system in and of itself is essentially conventional and does not form part of the assembly of the present invention.

However, it has been well established that various forms of gates and doors may be operated by these radio frequency transmitter-receiver systems. In some cases, these radio frequency operable systems operate a gate or door which is swung through an arcuate path from an opened to a closed, and from a closed to an opened, position. In other cases, the gate or door is such that it is designed to shift in a linear path from an opened to a closed, and also from a closed to an opened, position. Thus, for example, in many cases, the gate extends from a wall to a fence, and is shiftable through a linear path from the wall to the fence in order to open and close an opening to permit access and movement through the opening.

In many cases, and particularly with respect to those forms of gate opening and closing assemblies, the opening which permits passage, particularly of vehicles, is fairly large, such that the gate which moves in a linear path must traverse a fairly substantial distance. In order to accommodate the shiftable movement of a gate over a substantial distance through a linear path, mechanical actuating mechanism, which is capable of creating movement over this substantial distance, is also required.

In accordance with the prior art door opening mechanisms, a substantial distance was also required for the actuating mechanism to shift the gate from the closed to the opened, and from the opened to the closed, position. Thus, for example, the gate was connected to a rack bar which was in turn operated by a pinion, and which was in turn rotated through an electric motor upon actuation of a suitable switch mechanism. This form of door opener required a substantially large dimensional rack bar, generally at least equivalent to the length of movement of the door from the closed to the opened position. Other problems which were attendant to the conventional door opening mechanisms generally resided in the drive mechanism which utilized gear drives operated by an electric motor in combination with a rack bar connected to the gate or door. Typically, many of these drive mechanisms utilized a clutch which permitted engagement of the mechanism attached to the door or gate and the cooperating mechanism attached to the motor. These prior art devices were designed such that they did not provide constant and continuous efficient movement of the gate.

The present invention obviates these and other problems in the provision of a gate opening and closing assembly which is uniquely designed so that it converts rotary movement from an electric motor into linear motion which is capable of moving a gate from an opened to a closed position and in which the overall space requirement for the actuating mechanism is substantially less than the required distance of movement of the gate from the opened to the closed position, and from the closed to the opened, position.

OBJECTS OF THE INVENTION

It is, therefore, the primary object of the present invention to provide an improved gate opener which is uniquely designed to convert rotary motion into a linear motion for movement of a gate from an opened to a closed, and from a closed to an opened, position.

It is another object of the present invention to provide an assembly of the type stated which is highly efficient in its operation and requires a minimum amount of space in order to fully operate a gate for shiftable movement thereof.

It is a further object of the present invention to provide an assembly for opening and closing a gate over a substantially large distance by means of a mechanism which can be located in a relatively small space.

It is also an object of the present invention to provide a method of opening and closing a gate by utilizing an assembly which converts rotary motion into simple linear motion and harmonic motion.

It is also a salient object of the present invention to provide an assembly of the type stated which can be manufactured at a relatively low unit cost, but which is nevertheless highly efficient in its operation.

It is a further object of the present invention to provide a unique clutch mechanism which permits rotation of an output shaft through a drive source and which also permits operative disconnection and connection to the shaft and further controls the angular degree rotation of the shaft through selective stop mechanisms.

It is still a further object of the present invention to provide a method of disconnecting a drive member from a source of power through a unique clutch mechanism which controls the angular rotation of the drive member and also permits operative reconnection thereof.

With the above and other objects in view, my invention resides in the novel features of form, construction, arrangement and combination of parts presently described and pointed out in the claims.

BRIEF DESCRIPTION OF THE DRAWINGS

Figure 1:
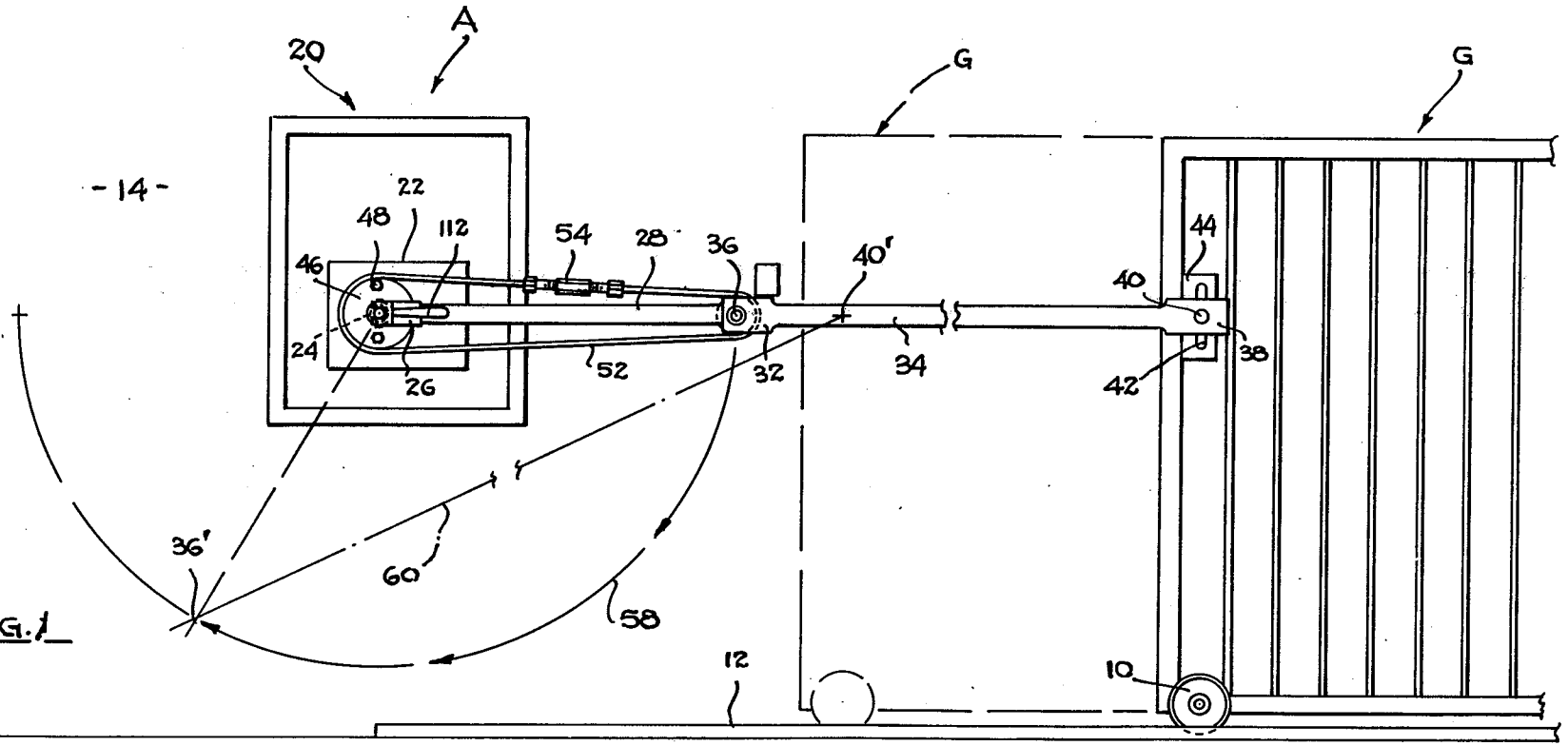
Figure 2:
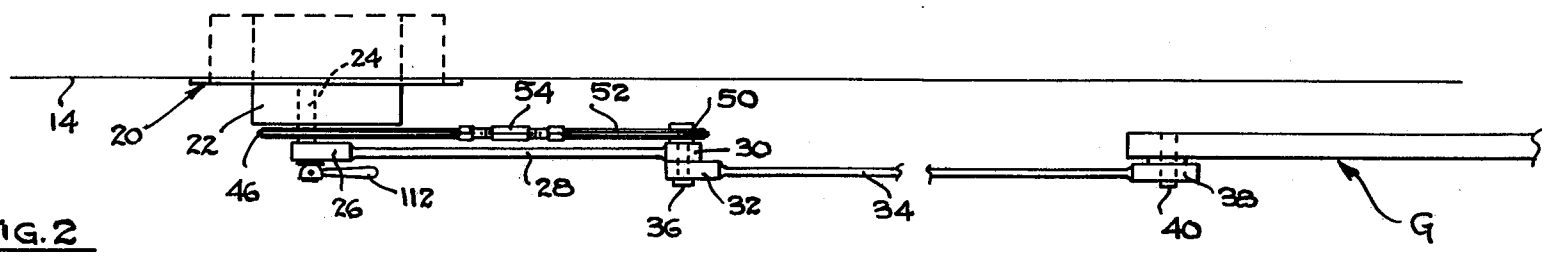
Figure 3D:
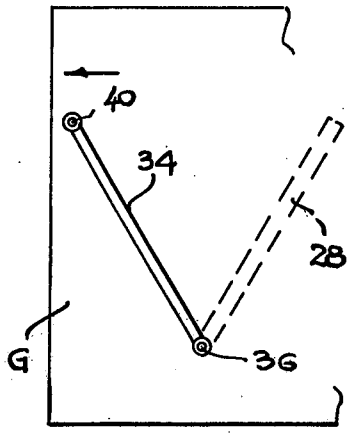
Figure 3C:
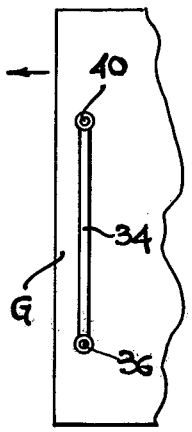
Figure 3B:
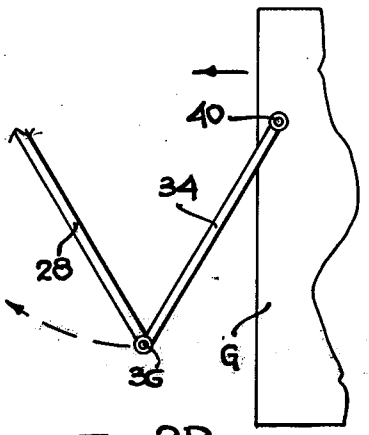
Figure 3A:
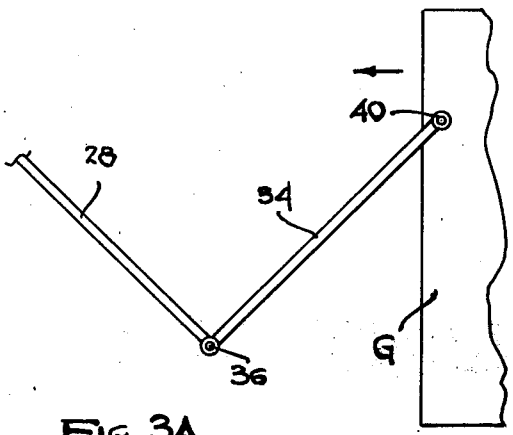

Having thus described the invention in general terms, reference will now be made to the accompanying drawings in which:

FIG. 1 is a fragmentary side-elevational view showing a gate opening assembly constructed in accordance with and embodying the present invention and shown connected to a shiftable gate;

FIG. 2 is a top-plan view of the assembly of FIG. 1, along with the shiftable gate;

FIG. 3 is a sequence of schematic views showing the shiftable movement of a pair of lever arms forming part of the assembly of FIGS. 1 and 2, and in which:

FIG. 3A shows a pair of lever arms shifting toward a position where they will be vertically disposed;

FIG. 3B illustrates the same pair of lever arms shifted more to the vertical position;

FIG. 3C shows the pair of lever arms in the vertically disposed position; and

Figure 7:
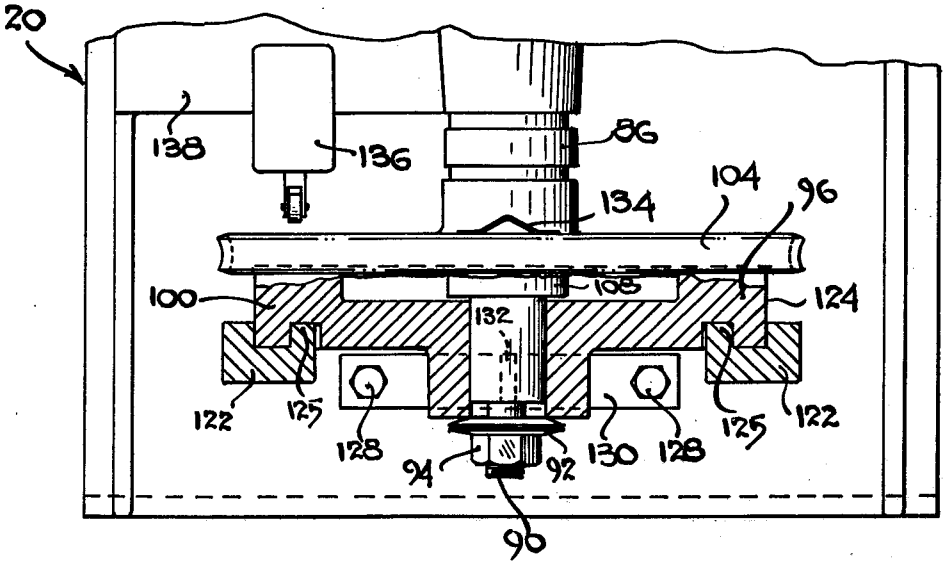
Figure 4:
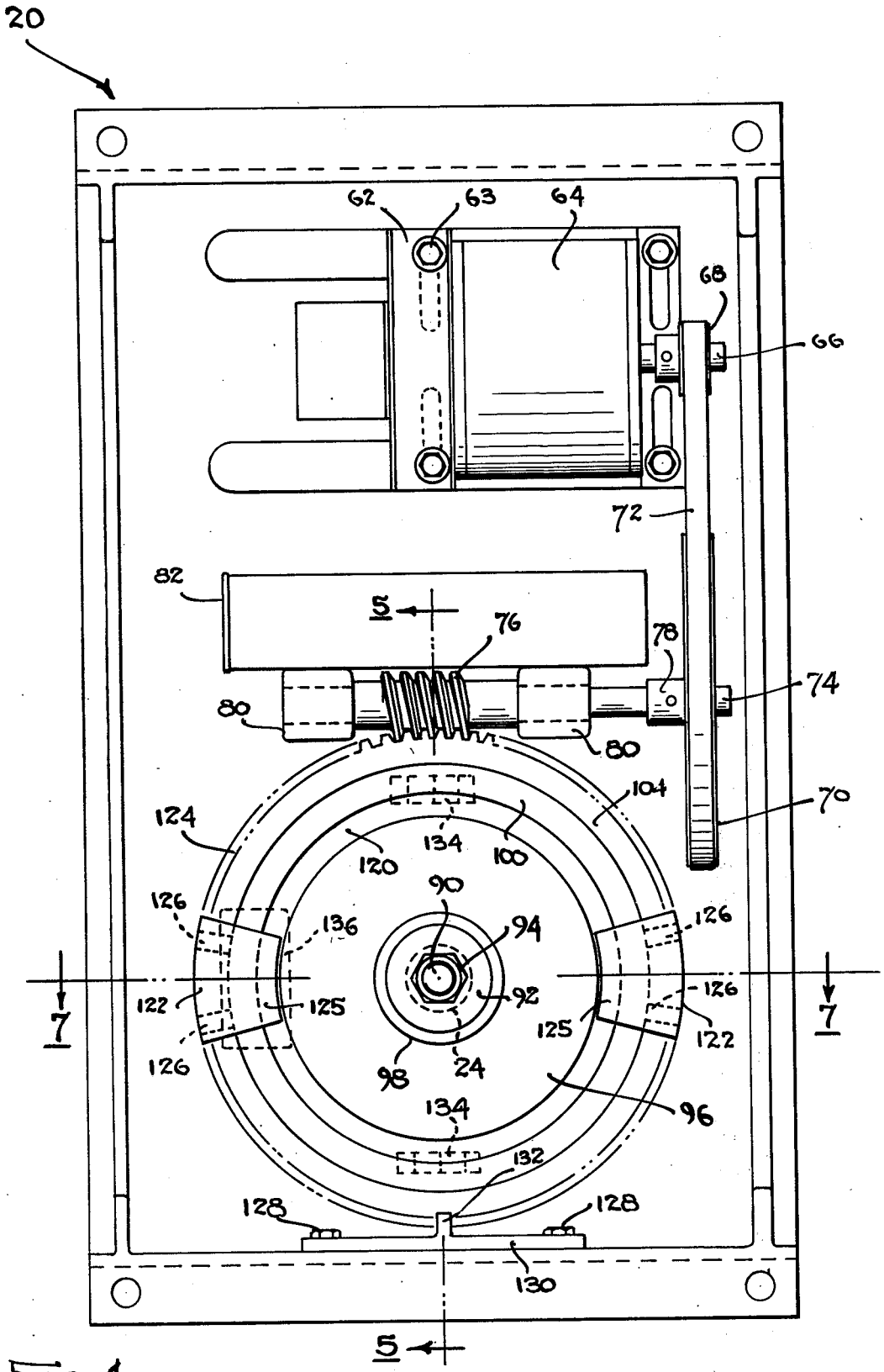
Figure 5:
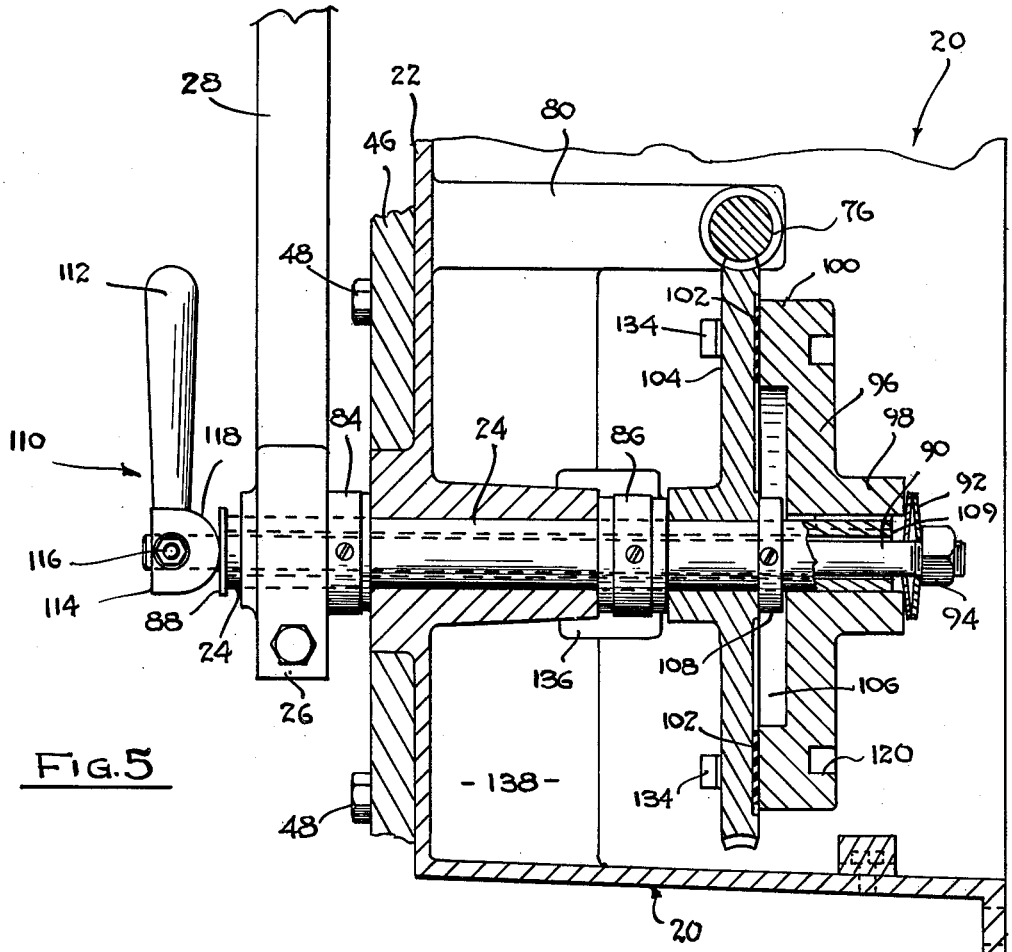
Figure 6:
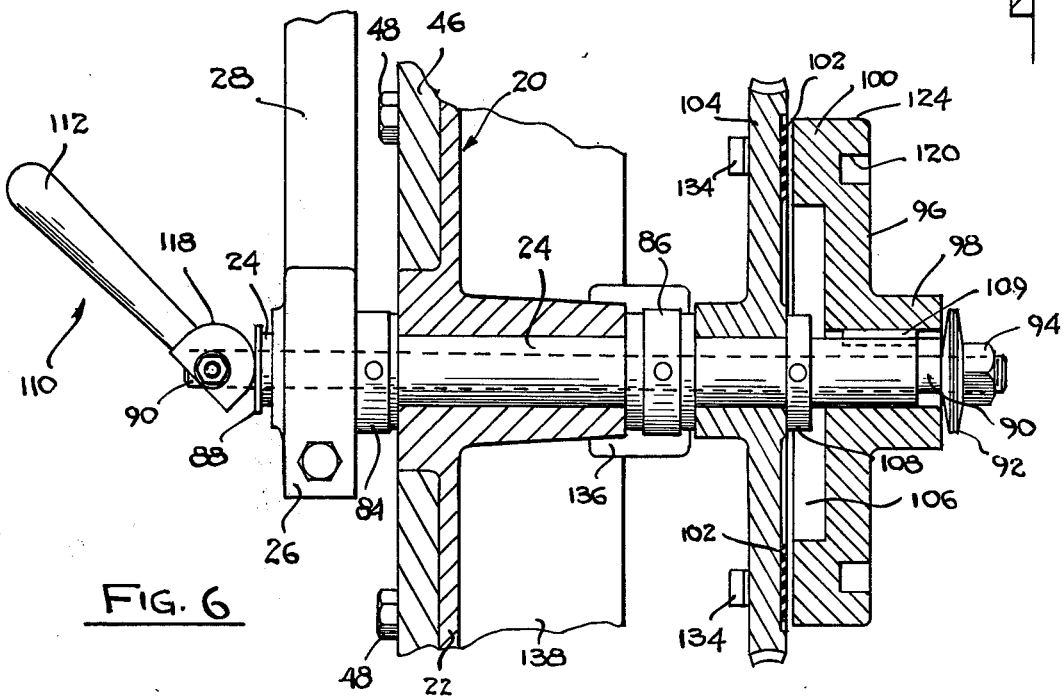

FIG. 3D illustrates the lever arms having crossed over each other and shifting toward a position where the gate is fully opened;

FIG. 4 is a rear elevational view showing a portion of the drive means forming part of the assembly of the present invention;

FIG. 5 is a fragmentary vertical sectional view showing a portion of the drive means of the assembly of the present invention and in this case, the drive means is illustrated with a clutch member in the engaged position;

FIG. 6 is a fragmentary vertical sectional view, similar to FIG. 5, and showing the drive means with the clutch mechanism is the disengaged position; and FIG. 7 is a fragmentary horizontal sectional view taken along line 7—7 of FIG. 4.

DETAILED DESCRIPTION

Referring now in more detail and by reference characters to the drawings which illustrate a practical embodiment of the present invention, A designates a gate opening and closing assembly shown in operative connection to a shiftable gate G. In this case, the gate G is shiftable from a closed position across an access opening to an opened position and from the opened position to the closed position by means of the assembly A. The gate G may be of any conventional construction and, as such, does not form part of the present invention per se. The gate G is conventionally provided with rollers 10 and which are movable along a trackway 12, the latter of which is disposed on the ground or other supporting surface.

In essence, gates of this type are typically used in security apartment buildings and similar commercial establishments and dwelling structures. The access opening permits passage of either people or vehicles, and the gate can be shifted from the closed to the opened position for such access. Generally, many of the commercially available prior art gate opening and closing assemblies operate on the basis of a radio frequency receiver-transmitter system, such that the party desiring to open the gate will actuate the transmitter to generate a signal which, in turn, causes the receiver to energize a motor for shifting the gate G. In essence, transmitter-receiver system operates as a switch and, in this respect, the present invention can be used in the absence of a conventional radio frequency operated transmitter-receiver system. Thus, for example, a simple key operated switch or the like could be used.

As used herein, the term "gate" is used in its generic sense to include doors and like structures, and essentially constitutes any movable framework or structure which controls the entrance or exit through an access opening to provide passageway.

The assembly A comprises a rectangular housing 20 which may be formed of any suitable sheet metal or the like and which is preferably recessed in a wall 14 which may form one of a pair of spaced apart fixed barriers which define the access opening. Nevertheless, the housing 20 can be mounted in any suitable location. The housing 20 is provided with a forwardly projecting, rectangularly shaped hub 22, and extending outwardly of the hub 22 is a hollow drive shaft 24. Mounted on the outer end of the drive shaft 24 and being rotatable therewith is an enlarged mounting boss 26 of a first lever arm 28 which serves as a driving arm.

The opposite end of the first lever arm 28 is also provided with an enlarged mounting boss 30 and is pivotally secured to an enlarged mounting boss 32 of a second lever arm 34, the latter of which serves as a driven arm. The pivotal connection between the two lever arms 28 and 34 is accomplished by means of a pivot pin 36 which may be retained in the enlarged mounting bosses 30 and 32 by means of suitable locking nuts, washers and the like (not shown). Finally, the opposite end of the lever arm 34 is similarly provided with an enlarged mounting boss 38 for pivotal connection to the gate G through a pivot pin 40.

It can be observed that the pivot pin 40 extends through an elongate slot 42 formed within a plate 44, the latter of which is rigidly secured to the gate G. This form of coupling of the lever arm 34 to the gate G is oftentimes desired in order to compensate for any nonlinearities in the positional movement of the gate G and any undesired variation in the movements of the two lever arms 28 and 34. However, it could be observed in connection with the present invention that the pivot pin 40 could be mounted in a fixed position so that it is not vertically shiftable in the manner as illustrated.

Concentrically disposed around the drive shaft 24 so as to be in coaxial alignment therewith is a first sprocket or pulley 46 which is nonrotatable and fixed to the hub 22 by means of a pair of fasteners 48, such as sheet metal screws or the like. Similarly affixed to the pivot pin 36 is a diametrally reduced sprocket 50. The sprocket 50 is coaxially aligned with the central axis of the pivot pin 36 and hence the pivotal connection between the two lever arms 28 and 34. In this case, the pivot pin 36 only rotates slightly relative to the enlarged mounting bosses 30 and 32 on the respective lever arms and only as the arms rotate. Trained around the sprockets 46 and 50 is a connecting chain 52 which may be provided with a conventional turn-buckle 54 for adjusting the overall size and degree of tension maintained on the chain 52. In the same respect, it can be observed that the sprockets 46 and 50 could be substituted by conventional pulleys and the chain 52 could be substituted for by a conventional belt.

The drive shaft 24 is connected to a suitable source of power for rotation thereof, in a manner to be hereinafter described in more detail. However, when the drive shaft 24 is rotated, it will cause rotation of the lever arm 28. By reference to FIG. 1, it can be observed that if the gate G is in the closed position as illustrated in the solid lines of FIG. 1, then the drive shaft will be rotated in a clockwise direction to cause rotation of the first lever arm 28 in a clockwise direction. The pivot pin 36 which constitutes the pivotal axis of the two arms 28 and 34 will move in a truely arcuate path designed by reference numeral 58. Moreover, the longitudinal axis of the lever arm 34 will also begin to shift through an arcuate path, effectively in a counter-clockwise direction. In essence, it can be observed that the pivot pin starts to shift downwardly and then to the left, reference being made to FIG. 1, as the lever arm 28 shifts through an arcuate path. This will cause the longitudinal axis of the lever arm 34 to assume the position designated by reference numeral 60 in FIG. 1 when the pivot pin 40 reaches the position designated as 40' in FIG. 1.

The various schematic views of FIG. 3 illustrate the arrangement of the first and second lever arms as the gate G shifts from the closed position toward the opened position. It can be observed that partially through the opening movement the first and second lever arms 28 and 34, respectively, will assume the position as illustrated in FIG. 3A. In this case, it can be observed that the pivot pin 36 has moved through the arcuate path as illustrated. FIG. 3B illustrates the position of the lever arms 28 and 34 as the gate G has shifted further to the opened position where the lever arms have assumed something approaching a vertical position. Finally, in FIG. 3C, it can be observed that the lever arms 28 and 34 are both truly in a vertical position. In this position the lever arms 28 and 34 are spaced apart transversely from each other only by a slight dimension. Moreover, it can be observed that the pivot pin 36 is in vertical alignment with the pivot pin 40. Continued movement of the gate G to the opened position will cause the lever arm 34 to essentially cross over the lever 28 to assume the position as illustrated in FIG. 3D of the drawings. In essence, it can be observed that the lever arms 28 and 34 could continue until the two arms were in a parallel relationship such that the lever arm 34 was on the lefthand side of the lever arm 28 when the gate is in the fully opened position.

In the preferred embodiment of the present invention, the angular rate of rotation of the lever arm 34 is equal to the angular rate of rotation of the lever arm 28. It can also be observed that if the length of each of the lever arms 28 and 34 is substantially equal between their points of pivotal connection, the pivot pin 40 will essentially travel in a straight line as the gate G is shifted from the closed to the opened position and from the opened to the closed position.

The construction described above will enable the rotation of the drive shaft 24 through the action of the motive means (hereinafter described) into a simple harmonic linear motion of the gate G. In essence, the gate G will move in a linear path. Moreover, as the two lever arms 28 and 34 assume the positions as illustrated in FIGS. 3A and 3B, the movement of the gate G from the closed to the opened position is accelerating. When the two lever arms 28 and 34 reach the position where they are vertically disposed, as illustrated in FIG. 3C, the maximum velocity of the gate G will have been achieved during its movement. Finally, as the gate G continues in its opening movement, the velocity will decrease proportionally to the extension of the two lever arms 28 and 34. In the same respect, it can be observed that the exact functions take place, only in opposite manner, when the gate G is shifted from the opened to the closed position. In essence, it can also be observed that the gate G accelerates to a point where the two lever arms 28 and 34 are vertically disposed and then gradually deccelerates until it reaches the fully opened position. Moreover, a minimum velocity results when the gate reaches either the fully opened or the fully closed position, such that the gate does not contact any other fixed barrier with any substantial force.

The chain 52 is effective in moving the two lever arms from a position where they could stall when the two are vertically disposed, as illustrated in FIG. 3C. By closely examining the structure, it can be observed that when the two lever arms have shifted through the positions illustrated in FIGS. 3A and 3B and reach a vertically disposed position as illustrated in FIG. 3C, they could stall the movement of the gate, since there is no "lever arm moment of force" to cause continuing movement of the two lever arms to the position as illustrated in FIG. 3D. The drive chain 52 overcomes this condition in that the chain 52 will effectively "walk" around the sprocket 46. Inasmuch as the sprocket 46 is fixed, the chain 52 will cause the sprocket 50 to rotate. Moreover, since the sprocket 46 is of substantially large diameter relative to the connection of the lever arm 28, the chain 52 is offset from the axis of rotation of the lever arm 28. This offset of the chain 52 and the motion imparted to the sprocket 50 will overcome any tendency of the lever arms to stall. It is believed that the chain being offset from the pivot pin 36 will cause a force having a downward vector and a horizontal vector moving to the left, reference being made to FIG. 1, when the gate is opening. At least this horizontal force component plus the force imparted by the rotating sprocket is believed responsible for moving the pivot pin to the left toward the position as illustrated in FIG. 3D from the position illustrated in FIG. 3C. In this respect, the drive sprockets 46 and 50 are of different diameters. In the preferred aspect of the present invention the sprockets 46 and 50 have a gear ratio of 2:1.

One of the unique aspects of the present invention is that it is possible to shift a relatively large gate from a fully opened to a fully closed position without the necessity of a large space to accommodate the attendant drive mechanism. Heretofore in the prior art, various forms of drive mechanisms utilized a source of power which caused a shiftable bar coupled to the gate to shift through a path equal to the length of movement of the gate. This form of mechanism was often difficult to install and, in many cases, impossible to implement in view of the fact that the barriers which define the access opening did not provide sufficient space to accommodate a drive bar equal to the length of movement of the gate.

In accordance with this invention, it can be observed that it is possible to utilize a pair of lever arms which are relatively short in length, but which move through arcuate paths in order to translate the rotary motion of the drive shaft into the linear motion for the gate. Moreover, by virtue of the mechanism heretofore described, it is possible to initially start the movement of the gate at a slow velocity and increase the velocity, and thereafter reduce the velocity to the point where the gate reaches the fully opened, or otherwise the fully closed, position. In this way, it is possible to reduce the effects of impact of the gate with either one of the barriers in the closed or opened positions.

It can also be observed that it is possible to utilize other forms of connecting means between the drive shaft 24 and the pivot pin 36 in order to overcome any possible stall in the movement of the two lever arms 28 and 34. Thus, for example, a rack bar could extend between the pivot pin 36 and the sprocket 46. Nevertheless, the lever arms 28 and 34 would move through the same positional paths as heretofore described and would have the same length and function in the same manner.

FIGS. 4 through 6 more fully illustrate the drive means which is used for creating the rotation of the drive shaft 24. As indicated previously, the drive means is located within the housing 20. The drive means comprises a bracket 62 which is mounted within the frame housing 20 and is secured to a wall of the housing 20 by means of bolts 63. Also fixedly secured to the bracket 62 is a conventional AC electric motor 64. The motor 64 has an output shaft 66 and mounted on the output shaft 66 is a drive pulley 68. The drive pulley 68 causes rotation of a diametrally enlarged pulley 70 through a drive belt 72. In this respect, the pulleys 68 and 70 and the drive belt 72 could be substituted by sprockets and a conventional drive chain, in the manner as previously described.

The cooperating pulley 70 is retained on an idler shaft 74 which is again secured to the frame housing 20, and similarly mounted on the idler shaft 74 and being rotatable therewith is a worm gear 76, in the manner as illustrated in FIG. 4.

The idler shaft 74 is provided with a collar 78 on one side of the cooperating pulley 70, in the manner as illustrated in FIG. 4. In addition, the idler shaft 74 is journaled in spaced apart bearing blocks 80 affixed to a bracket 82, the latter of which is, in turn, secured to one of the sidewalls of the housing 20, also in the matter as illustrated in FIG. 4 of the drawings.

The hollow drive shaft 24 is rotatable and is provided with a forwardly located collar 84 located between the pulley 26 and the front wall of the housing 20. In addition, a second collar 86 is located interiorly of the housing in the manner as illustrated in FIGS. 5 and 6 of the drawings. At its forwardmost end, the hollow drive shaft 24 is provided with a relatively flat bearing plate 88, also in the manner as illustrated in FIGS. 5 and 6 of the drawings.

Extending through the hollow drive shaft 24 is a clutch shaft 90 which extends concentrically through the hollow drive shaft 24 and is rotatable with the hollow drive shaft 24, but is also axially shiftable independently of the drive shaft 24, in a manner hereinafter to be described in more detail. The clutch shaft 90 is secured at its inner-end by means of a pair of spring-discs 92 which serve as a so-called "Belliville" spring and a locking nut 94. Also mounted on the drive shaft 24 is a clutch plate 96, having an enlarged large mounting hub 98 and a circumferentially extending flange 100 which bears against a continuous clutch pad 102. The clutch pad 102 is mounted in an enlarged worm wheel 104, the latter having an annular gear segment disposed in meshing engagement with the worm gear 76, in the manner as illustrated in FIG. 5 of the drawings. It should be understood that the clutch pad 102 could be mounted in the flange 100 to bear against the worm wheel 104. In addition, it can be observed that a space 106 is created between the clutch plate 96 and the worm wheel 104 created by the extended flange 100. Moreover, a spacing collar 108 is secured to the drive shaft 24 and is located between clutch plate 96 and the gear wheel 104 and also in the manner as illustrated in FIG. 5 of the drawings.

It can be observed that the gear wheel 104 not only cooperates with the worm gear 76 in order to drive the clutch plate 96, but also cooperates with the clutch plate 96 and in this case, the gear wheel 104 will also serve as a cooperating clutch plate. Thus, by reference to FIG. 5, it can be observed that the clutch plate 96 is located in engagement with the gear wheel 104 through the pad 102 which engages the interior surface of the gear wheel 104. However, it can be observed that the clutch plate 96 can be separated from the gear wheel 104, in the manner as illustrated in FIG. 6 of the drawings.

The drive shaft 24 is independently rotatable of the clutch shaft 90. However, the clutch shaft 90 is rotatable with the clutch plate 96 and is also axially keyed thereto through a key-way 109. In accordance with this construction, it can be observed that the clutch shaft 90 is axially shiftable with respect to the drive shaft 24, but is rotatable with the drive shaft 24. In the same respect, the clutch plate 96 is rotatable with the drive shaft 94, but is also independently axially shiftable thereto by relative movement of the clutch shaft 90.

Secured to the outer end of the clutch shaft, in the manner as illustrated in FIGS. 5 and 6 is an actuating handle 110 which comprises a handle arm 112 secured to a cam plate 114. However, by reference to FIGS. 5 and 6 of the drawings, it can be observed that the cam plate 114 is secured to the outermost end of the clutch shaft 90 by means of a locking pin 116. The cam plate 114 includes an arcuately shaped caming surface 118 which is designed to bear against the flat plate 88 in the manner as illustrated in FIG. 5 in order to create an engagement between the clutch plate 94 and the worm wheel 104. In this case, it can be observed that when the handle arm 112 is in a locked position, that is a position parallel to the arm 28, the spring 92 will be compressed, so that the cam plate 96 is in meshing engagement with the worm wheel 104. In this way, the cam plate 96 will rotate with the worm wheel 104.

It is also possible to create disengagement between the cam plate 96 and the worm wheel 104 by shifting the handle arm 112 to an open position as illustrated in FIG. 6 of the drawings. It can be observed that the plates of the Belliville spring 92 can be released in order to permit a slidable separation between the clutch plate 96 and the worm wheel 104, in the manner as illustrated in FIG. 6. In this case, the cam plate 96 will not rotate with the worm wheel 104.

It can be observed, by further reference to FIG. 6, that when the lever arm 112 is pulled outwardly the caming surface 118 is removed from engagement with the flat plate 88. In this way, the clutch shaft 90 is permitted to shift axially rearward inasmuch as the caming surface 118 will not cause the compression of the plates forming a part of the Belliville spring 92. In this way, clutch plate 96 is no longer in engagement with the worm wheel 104. Moreover, it can be observed that the worm wheel 104 can rotate freely and independently of the clutch plate 96.

This construction is highly desirable inasmuch as it permits a manual rotation of the drive shaft 24 to permit manual opening or closing of the gate G without interference of any of the mechanism included in the motive drive means. However, in like manner, when the handle arm 112 is shifted to its upright position (FIG. 5) so that it provides compression of the plates forming a part of the Belliville spring 92, the clutch plate 96 will be disposed in engagement with the worm wheel 104. In this way, rotation of the drive shaft 24 and hence the movement of the gate G is created through the motor 64. In this respect, it can be observed that if the motor 64 is inoperative or any of the connecting mechanisms is inoperative, then the gate G can still be opened by mere release of the handle arm 112 and a cranking movement thereof in order to shift the gate from the open to the closed or from the closed to the open position.

One of the unique aspects of this construction in accordance with the present invention is that the gate G may be easily opened in the event of a failure of motor 64. In this case, the user of the apparatus only has to shift the handle arm 112 about the pivot pin 116 and the clutch shaft 90 to the fully opened position where it is essentially parallel to the axis of the clutch shaft 90. In this way, the clutch plate 96 will become disengaged with the worm wheel 104 and permit rotation of the clutch plate of the clutch shaft 90 independently of the drive shaft 24. Thus, the user of the device may crank the gate G either to the open or closed position. However, if one desires, the motor 64 can be utilized to perform this function merely by shifting the handle arm 112 to the closed position, that is the position as illustrated in FIG. 5 of the drawings. When the handle arm 112 is shifted to the closed position, the Belliville spring 92 will compress and thereby cause frictional engagement between the clutch plate 96 and the worm wheel 104. In this way, the motor 64 can permit rotation of the worm wheel 104 and hence the clutch plate 96 in order to rotate both the clutch shaft 90 and the drive shaft 24 which will thereupon rotate simultaneously with each other.

The clutch plate 96 is provided on its interior surface with an annular groove 120 in the manner as illustrated in FIGS. 5 and 6 of the drawings. A pair of spaced apart stop bars, often referred to as "locking bars", 122 are secured to the peripheral surface 124 of the clutch plate 96 by means of a pair of locking screws 126. Moreover, the stop bars 122 are provided with in-turned flanges 125 which are adapted to fit within the groove 120 and to be locked with respect to the clutch plate 96 by means of locking screws 126.

By further reference to FIG. 4 of the drawings it can be observed that the locking bars 122 can be shifted circumferentially around the clutch plate 96. In this way, the desired degree of rotation of clutch plate 96 can be obtained with respect to the relative positions of the locking bars 122. In like manner, the amount of rotational movement of the gate G can be controlled through the locking bars 122.

Mounted on the bottom wall of the housing 20 by means of sheet metal screws 128 is a plate 130, and integrally formed with the plate 130 is an upstanding tab 132 which is located to be engaged by either of the flat surfaces of the locking bars 122. In this way, as the clutch plate 96 rotates, its movement will be limited by the engagement of either of the locking bars against the upstanding tab 132. Accordingly, it can also be observed that the limit of movement of the clutch plate 96 and hence the drive shaft 24 can be controlled merely by positioning of the locking bars 122.

Also mounted on the forwarded presented surface of the worm wheel 104, reference being made to FIG. 7, are a pair of limit switch actuators 134. These limit switch actuators 134 are engagable with a limit switch 136, the latter mounted on an internal web 138 extending across a pair of walls of the housing 20. In this way, the locking bars, often called "dogs" 122 control the rotational movement of the cam plate 96 and the limit switches will control energization and de-energization of the motor 64. Thus, it can be observed that the locking bars 122 may contact the upstanding tab 132 and thereby stop rotational movement of the cam plate 96. The limit switch 136 will thereupon cause de-energization of the motor 64.

It can be observed that when the handle 112 is shifted to the open position as illustrated in FIG. 6 of the drawings, that disengagement of the clutch plate 96 and the worm wheel 104 can occur. Inasmuch as the worm wheel is rotatable with respect to clutch plate 96, proper phase orientation of the limit switch actuators 134 with respect to the locking bars 122 can be disturbed. However, it can be observed that the worm wheel 104 is not physically locked to the drive shaft 24. Thus, when the handle 112 is shifted to the closed position as illustrated in FIG. 5, the clutch plate 96 will thereupon engage the worm wheel 104. This engagement may result even though a lack of proper phase orientation exists between the limit switch actuators 134 and the locking bars 122. Nevertheless, when the motor 64 is energized, the clutch plate 96 will rotate until one of the locking bars 122 engages the upstanding tab 132. Nevertheless, the motor limit switch actuators 134 may not be in a position to contact the limit switch 136. The motor 64 will still remain energized and will cause rotation of the worm wheel 104, e.g. slipping on the drive shaft 24, until such time as the limit switch is contacted by one of the actuators. At that point, the motor 64 will become de-energized. In this way, it can be observed that upon re-energization of the motor, the limit switch actuators 134 will then be located in correct phase correlation with respect to the locking bars 122.

It should be observed that the unique door opening and closing assembly of the present invention could be used in a wide variety of environments in which rotary motion is converted to linear motion for shifting a movable member. While the unique assembly of the present invention has been designed, in this embodiment, for the closing and opening of gates it should also be observed that it could be used in environments for shifting members in a reciprocative path where reciprocative motion is desired. In other applications, the assembly of the present invention could be used for raising and lowering of platforms and like structures.

Thus, there has been illustrated and described a unique and novel improved gate opening and closing assembly which is capable of converting rotational motion into linear motion and which therefore fulfills all of the objects and advantages sought therefor. It should be understood that many changes, modifications, variations, and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention which is limited only by the following claims.

Having thus described my invention, what I desire to claim and secure by letters Patent is:

1. An assembly for shifting a gate from a closed position across an access opening to an opened position and from the opened position to the closed position, said assembly comprising (a) a drive motor, (b) a first lever arm operatively coupled to said drive motor, and capable of being driven through an arcuate path upon energization of said motor, (c) a second lever arm pivotally coupled to said first lever arm by a pivotal connection, said second lever arm also moving through a somewhat arcuate path upon movement of said first lever arm, said first and second lever arms each being substantially smaller in length than the length of movement of said gate across said access opening and said first lever arm having its longitudinal axis generally parallel in space to the longitudinal axis of said second lever arm and when the gate is in the closed position, said lever arms being aligned with one another when said gate has moved over a portion of the access opening between the closed and opened positions, said lever arms crossing over one another when said gate has moved over a further portion of the access opening in the direction of travel and said lever arms separating away from the aligned position after crossing over one another in the same direction of travel so that said gate further moves across said access opening in the same direction of travel, (d) and means pivotally coupling said second lever arm to said gate.

2. The assembly of claim 1 further characterized in that said first and second lever arms are pivotally connected to each other at points in proximity to the associated ends of the arms.

3. The assembly of claim 1 further characterized in that said first lever arm is operatively coupled to said drive motor through a drive shaft and said first and second lever arms are connected to each other through a pivot member.

4. The assembly of claim 1 further characterized in that said first and second lever arms are substantially equidistant in length.

5. The assembly of claim 4 further characterized in that said first and second lever arms are connected in such manner as to move said gate in a linear path.

6. The assembly of claim 4 further characterized in that said first and second lever arms are connected in such manner as to move said gate in a linear path, and that the movement of said gate in said linear path is harmonic in nature.

7. An assembly for shifting a member from a first position to a second position and from the second position to the first position, said assembly comprising:

(a) a drive motor, (b) a first lever arm operatively coupled to said drive motor, and capable of being driven through an arcuate path upon energization of said motor, (c) a second lever arm pivotally coupled to said first lever arm by a pivotal connection, said second lever arm also moving through a somewhat arcuate path upon movement of said first lever arm, said first and second lever arms each being substantially smaller in length than the length of movement of said member in one direction and said first lever arm having its longitudinal axis parallel in space to the longitudinal axis of said second lever arm and when the member is in the first position, said lever arms being aligned with one another when said member has moved over a portion of the distance between the first and second positions, said lever arms crossing over one another when said member has moved over a further portion of the distance between the first and second positions in the direction of travel and said lever arms separating away from the aligned position after crossing over one another in the same direction of travel so that said member further moves across said distance in the same direction of travel, (d) and means pivotally coupling said second lever arm to said member.

8. The assembly of claim 7 further characterized in that said first and second lever arms are substantially equidistant in length.

9. The assembly of claim 8 further characterized in that said first and second lever arms are connected in such manner as to move said member in a linear path.

10. The assembly of claim 8 further characterized in that said first and second lever arms are connected in such manner as to move said member in a linear path and that the movement of said member in said linear path is harmonic in nature.

11. A method for shifting a member from a first position to a second position and from said second position to said first position through a linear path, said method comprising causing rotational movement of a first lever arm by a motive means, causing movement of a second lever arm through a somewhat arcuate path by a pivotal connection between said first and second lever arms, locating said lever arms so that each of said lever arms have a longitudinal axis parallel to a longitudinal axis of the other of said lever arms when said member is in the first position, and moving said member between said first and second positions as said first and second lever arms move by a pivotal connection between said second lever arm and said member, said lever arms being aligned with one another when said member has moved over a portion of the distance between the first and second positions, said lever arms crossing over one another when said member has moved over a further portion of the distance between the first and second positions in the direction of travel and said lever arms separating away from the aligned position after crossing over one another in the same direction of travel so that said member further moves across said distance in the same direction of travel.

12. The method of claim 11 further characterized in that said member is a gate and said method shifts said gate from a first position which constitutes a closed position to a second position which constitutes an opened position across an access opening.

13. The method of claim 11 further characterized in that said method comprises initially moving said arms in opposite arcuate directions.

14. The method of claim 11 further characterized in that said first and second lever arms are substantially equidistant in length.

15. The method of claim 14 further characterized in that said first and second lever arms are connected in such manner as to move said member in a linear path.

16. The method of claim 14 further characterized in that said first and second lever arms are connected in such manner as to move said member in a linear path and that the movement of said member in said linear path is harmonic in nature.

17. An apparatus for driving a driven member through a rotatable path with an engine and optionally with manual actuation thereof, said apparatus comprising:

(a) a main drive shaft having a central bore extending therethrough, (b) a driven member mounted on one end of said drive shaft and being rotatable with said drive shaft, (c) a clutch member operatively mounted on the opposite end of said drive shaft, (d) a clutch shaft extending through the central bore of said main drive shaft, (e) an engine operatively coupled to said drive shaft to cause rotation thereof when said engine is energized, (f) a manually operable handle operatively mounted on one end of said clutch shaft corresponding to the first named one end of said drive shaft, said manually operable handle being shiftable from a first position where said engine is operatively coupled to said drive shaft to a second position where said engine is operatively disconnected from said drive shaft, (g) and spring means operatively located on the opposite end of said clutch shaft and permitting operative engagement of said engine to said drive shaft when said handle is in said first position and being released to permit disengagement of said drive shaft from said engine when said handle is shifted to said second position.

18. The apparatus of claim 17 further characterized in that said driven member is rotatable through an arc of no greater than 360°.

19. The apparatus of claim 17 further characterized in that said engine is an electrically energized motor.

20. The apparatus of claim 17 further characterized in that said driven member is an arm which forms part of an assembly for shifting a gate from an open position to a closed position and from the closed position to the open position.

21. The apparatus of claim 17 further characterized in that said clutch member is rotatable with and is axially shiftable on said clutch shaft, and that a drive gear engageable with said clutch member is rotatable independently of said drive shaft and clutch shaft when said handle is shifted to said second position.

22. The apparatus of claim 21 further characterized in that a camming element is operatively associated with said handle to permit engagement and disengagement of said drive gear with said clutch member.

23. An assembly for shifting a driven member from a first position to a second position and from the second position to the first position, said assembly comprising:

(a) a drive motor, (b) a main drive shaft driven by said motor and having a central bore extending therethrough, (c) a first lever arm mounted on said drive shaft and capable of being driven through an arcuate path upon energization of said motor, (d) a second lever arm pivotally coupled to said first lever arm by a pivotal connection, said second lever arm also moving through a somewhat arcuate path upon movement of said first lever arm, said second and first lever arms each being substantially smaller in length than the length of movement of said member in one direction and each of said lever arms having one of their axes parallel in space to a similar axis of the other of said lever arms, (e) means pivotally coupling said second lever arm to said member, (f) a clutch device operatively mounted on the opposite end of said drive shaft, (g) a clutch shaft extending through the central bore of said main drive shaft, (h) a manually operable handle operatively mounted on one end of said clutch shaft corresponding to the first named one end of said drive shaft, said manually operable handle being shiftable from a first position where said motor is operatively coupled to said drive shaft to a second position where said motor is operatively disconnected from said shaft, (i) and spring means operatively located on the opposite end of said clutch shaft and permitting operative engagement of said motor to said drive shaft when said handle is in said first position and being released to permit disengagement of said drive shaft from said motor when said handle is shifted to said second position.

24. The assembly of claim 23 further characterized in that said clutch member is rotatable with and is axially shiftable on said clutch shaft, and that a drive gear engageable with said clutch mechanism is rotatable independently of said drive shaft and clutch shaft when said handle is shifted to said second position.

25. The assembly of claim 23 further characterized in that said first and second lever arms are pivotally connected to each other at points in proximity to the associated ends of the arms.

26. The assembly of claim 23 further characterized in that said first and second lever arms are substantially equidistant in length and that said first and second lever arms are connected in such manner as to move said member in a linear path.

27. The assembly of claim 23 further characterized in that said driven member is a gate shiftable from a first position constituting an open position to a second position constituting a closed position across an access opening.

28. Apparatus for controlling the degree of rotational movement of a drive shaft having a driven member mounted on said drive shaft for rotational movement therewith, said apparatus comprising:

(a) an outer housing, (b) a drive shaft extending through said housing and having a first end and a second end with a central bore extending therethrough, (c) an inner shaft extending through the central bore of said drive shaft and having a first end corresponding to the first end of said drive shaft and a second end corresponding to the second end of said drive shaft, (d) a driven member mounted on the first end of said drive shaft and being rotatable therewith, (e) a clutch plate mounted on the second end of said inner shaft, (f) a cooperating clutch member mounted on said drive shaft and being engageable with said clutch plate, (g) at least one limit bar on said clutch plate and being adjustably positional thereon, (h) and a cooperating stop bar associated with said housing and being located to be engageable by said limit bar to control the rotational movement of said drive shaft and said driven member.

29. The apparatus of claim 28 further characterized in that a plurality of spaced apart limit bars are adjustably positional on said camming plate.

30. The apparatus of claim 28 further characterized in that said clutch plate is rotatable with and axially shiftable on said inner shaft and that said cooperating clutch member can be rotatable independently of said inner shaft.

31. The apparatus of claim 28 further characterized in that said driven member controls a gate shiftable from a closed position to an open position and from said open position to the closed position across an access opening.

32. An assembly for shifting a gate from a closed position across an access opening to an opened position and from the opened position to the closed position, said assembly comprising:

(a) a drive motor having a drive shaft, (b) a first lever arm operatively coupled to said drive motor through said drive shaft, and capable of being driven through an arcuate path upon energization of said motor, (c) a second lever arm pivotally coupled to said first lever arm by a pivot member forming a pivotal connection therebetween, said second lever arm also moving through a somewhat arcuate path upon movement of said first lever arm, said first and second lever arms each being substantially smaller in length than the length of movement of said gate across said access opening and each of said lever arms having one of their axis parallel in space to a similar axis of the other of said lever arms, (d) means pivotally coupling said second lever arm to said gate, (e) a non-rotatable disc-like element fixedly mounted in relation to said drive shaft, (f) a cooperating disc-like element rotatably mounted at said pivot member, (g) and continuous member extending between and trained about said disc-like elements to cause said cooperating disc-like element to rotate in relation to the rotation of said first and second lever arms, said non-rotatable disc-like element having a larger diameter than said cooperating disc-like element such that the continuous member causes said cooperating disc-like element to rotate when said lever arms move and thereby overcomes any tendency of said lever arms to stall.

33. The assembly of claim 32 further characterized in that said elements are sprocket-like devices and said continuous drive means is a chain-like member.

34. The assembly of claim 32 further characterized in that said lever arms are aligned with one another when said gate has moved over a portion of the access opening between the closed and opened positions, said lever arms crossing over one another when said gate has moved over a further portion of the access opening in the direction of travel and said lever arms separating away from the aligned position after crossing over one another in the same direction of travel so that said gate further moves across said access opening the same direction of travel.

35. The assembly of claim 24 further characterized in that said arms each have a longitudinal axis which are generally parallel when the gate is in the closed position.

36. Apparatus for controlling the degree of rotational movement of a drive shaft having a driven member mounted on said drive shaft for rotational movement therewith, said apparatus comprising:

(a) an outer housing, (b) a drive shaft extending through said housing and having a first end and a second end with a central bore extending therethrough, (c) an inner shaft extending through the central bore of said drive shaft and having a first end corresponding to the first end of said drive shaft and a second end corresponding to the second end of said drive shaft, (d) a driven member mounted on the first end of said drive shaft and being rotatable therewith, (e) a clutch plate mounted on the second end of said inner shaft, (f) a cooperating clutch member mounted on said drive shaft and being engageable with said clutch plate, (g) at least one limit bar associated with said clutch plate and being adjustably positional with respect thereto, (h) and a cooperating stop bar associated with said housing and being located to be engageable by said limit bar to control the rotational movement of said drive shaft and said driven member.

37. The apparatus of claim 36 further characterized in that a plurality of spaced apart limit bars are adjustably positional with respect to said camming plate and are rotational with said camming plate.

38. The apparatus of claim 36 further characterized in that said clutch plate is rotatable with and axially shiftable on said inner shaft and that said cooperating clutch member can be rotatable independently of said inner shaft.

39. The apparatus of claim 36 further characterized in that said driven member controls a gate shiftable from a closed position to an open position and from said open position to the closed position across an access opening.

40. A gage opening and closing assembly for moving a gate from a closed position through an access opening to an open position and back from the open position to the closed position, said assembly comprising:

(a) motive means for powering movement of said gate, (b) a first lever arm, (c) first coupling means operatively coupling said first lever arm to said motive means and said first lever arm being powered for movement thereby, (d) a second lever arm, (e) second coupling means operatively coupling said second lever arm to said gate, (f) pivot means pivotally connecting the free ends of each of said first and second lever arms, said pivot means being generally aligned with the longitudinal axis of each of said first and second lever arms when said gate is in the closed position, said motive means causing said first and second coupling means to move toward each other in a generally horizontal path and said pivot means to progressively move downwardly away from said horizontal path as said gate is moved from one of said positions to the other of said positions, said lever arms becoming aligned with each other and thereafter crossing over each other during a portion of the movement of said gate from one of the positions to the other of the positions and said pivot means being vertically aligned with and beneath said first and second coupling means when said lever arms become aligned.

41. The assembly of claim 40 further characterized in that said first coupling means couples an end of said first lever arm opposite that which receives the pivot means to said motive means, and said second coupling means couples an end of said second lever arm opposite that which receives the pivot means to said gate.

42. The assembly of claim 40 further characterized in that said motive means comprises an electrically operable motor, and means forming part of said motive means for manually actuating and moving said lever arms independently of said motor.

43. A gate opening and closing assembly for moving a gate from a closed position through an access opening to an open position and back from the open position to the closed position, said assembly comprising:

(a) motive means for powering movement of said gate, (b) a first lever arm, (c) first coupling means operatively coupling said first lever arm to said motive means and said first lever arm being powered for movement thereby, (d) a second lever arm, (e) second coupling means operatively coupling said second lever arm to said gate, (f) pivot means pivotally connecting the free ends of each of said first and second lever arms, said pivot means being generally aligned with the longitudinal axis of each of said first and second lever arms when said gate is in the closed position, said motive means causing said first and second coupling means to move toward each other in a generally horizontal path and said pivot means to progressively move downwardly away from said horizontal path as said gate is moved from one of said positions to the other of said positions, said first coupling means crossing over said second coupling means and moving to the position initially occupied by said second coupling means, and said second coupling means moving toward the position initially occupied by said first coupling means after crossing over.

* * * * *